United States Patent [19]

Simpson et al.

[11] Patent Number: 4,740,253

[45] Date of Patent: Apr. 26, 1988

[54] METHOD FOR PREASSEMBLING A COMPOSITE COUPLING

[75] Inventors: John A. Simpson, Mountain View; Keith Melton, Cupertino; Tom Duerig, Fremont, all of Calif.

[73] Assignee: Raychem Corporation, Menlo Park, Calif.

[21] Appl. No.: 783,371

[22] Filed: Oct. 7, 1985

[51] Int. Cl.[4] ..... C22F 1/10

[52] U.S. Cl. ..... 148/11.5 R; 148/402

[58] Field of Search ..... 148/402, 11.5 R, 11.5 N, 148/11.5 F; 428/960

[56] References Cited

U.S. PATENT DOCUMENTS

| | | | |
|---|---|---|---|
| 3,740,839 | 6/1973 | Otte et al. | 428/960 |
| 3,753,700 | 8/1973 | Harrison et al. | 148/402 |
| 4,035,007 | 7/1977 | Harrison et al. | 148/402 |
| 4,036,669 | 7/1977 | Brook et al. | 148/402 |
| 4,067,752 | 1/1978 | Brook et al. | 148/402 |
| 4,095,999 | 1/1978 | Brook et al. | 428/960 |
| 4,149,911 | 4/1979 | Clabburn | 148/402 |
| 4,198,081 | 4/1980 | Harrison et al. | 428/960 |
| 4,205,293 | 5/1980 | Melton et al. | 148/402 |
| 4,379,575 | 4/1983 | Martin | 148/402 |
| 4,455,041 | 6/1984 | Martin | 428/960 |
| 4,469,357 | 9/1984 | Martin . | |
| 4,502,896 | 3/1985 | Duerig et al. | 148/402 |
| 4,533,411 | 8/1985 | Melton | 148/11.5 F |

OTHER PUBLICATIONS

Military Specification–Fittings, Tube, Fluid Systems, Separable, Dynamic Beam Seal, General Requirements for, MIL-F-85421, Feb. 11, 1981.

U.S. Government Printing Office, 1981-703 023 1155, pp. 1-20.

U.S. patent application, "Nickel/Titanium/Vanadium Shape Memory Alloy", by Mary P. Quin, filed Oct. 14, 1983, U.S. Ser. No. 541,844.

U.S. patent application, "Nickel/Titanium/Copper Shape Memory Alloy", by John D. Harrison, filed Sep. 29, 1983, U.S. Ser. No. 537,316.

Transformation Pseudoelasticity and Deformation Behavior in a Ti-50.6 at % Ni Alloy by S. Miyazaki et al., in Scripta Metallurgica, vol. 15, pp. 287-292, 1981, Pergamon Press Ltd., U.S.A.

*Primary Examiner*—L. Dewayne Rutledge
*Assistant Examiner*—S. Kastler
*Attorney, Agent, or Firm*—Herbert G. Burkard

[57] ABSTRACT

There is disclosed a method of preassembling a composite coupling. The coupling has at least one heat-recoverable driver member and at least one metallic insert. The driver member is made from a nickel/titanium-based shape memory alloy having a transformation hysteresis defined by $M_s$, $M_f$, $A_s$ and $A_f$ temperatures. The method includes the steps of overdeforming the driver member by applying a stress sufficient to cause nonrecoverable strain in the driver member so that the $A_s$ and $A_f$ temperatures are temporarily raised to $A_{s'}$ and $A_{f'}$, respectively; removing the stress; engaging the driver member and insert; and then warming the driver and insert to a temperature less than $A_{s'}$. There is also disclosed a composite coupling processed by this method.

20 Claims, 1 Drawing Sheet

METHOD FOR PREASSEMBLING A COMPOSITE COUPLING

BACKGROUND OF THE INVENTION

This invention relates to the field of methods and processes suitable for producing a nickel/titanium-based shape memory alloy composite coupling.

Materials, both organic and metallic, capable of possessing shape memory are well known. An article made of such materials can be deformed from an original, heat-stable configuration to a second, heat-unstable configuration. The article is said to have shape memory for the reason that, upon the application of the heat alone, it can be caused to revert or attempt to revert from its heat-unstable configuration to its original heat-stable configuration, i.e., it "remembers" its original shape.

Among metallic alloys the ability to possess shape memory is a result of the fact that the alloy undergoes a reversible transformation from an austenitic state to a martensitic state with a change of temperature. Also, the alloy is considerably stronger in its austenitic state than in its martensitic state. This transformation is sometimes referred to as a thermoelastic martensitic transformation. An article made from such an alloy, for example, a hollow sleeve, is easily deformed from its original configuration to a new configuration when cooled below the temperature at which the alloy is transformed from the austenitic state to the martensitic state. The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete), the deformed object will begin to return to its original configuration.

Commercially viable alloys of nickel and titanium have been demonstrated to have shape-memory properties which render them highly useful in a variety of applications.

Shape-memory alloys have found use in recent years in, for example, pipe couplings (such as are described in U.S. Pat. No. 4,035,007 and 4,198,081 to Harrison and Jervis and U.S. Pat. No. 4,149,911 to Clabburn), electrical connectors (such as are described in U.S. Pat. No. 3,740,839 to Otte and Fischer), switches (such as are described in U.S. Pat. No. 4,205,293 to Melton and Mercier), etc., the disclosures of which are incorporated herein by reference.

Since the austenite phase is stronger than the martensite phase, it is, of course, advantageous to have the alloy austenitic at the service temperature which is often but not necessarily near room temperature. In fact, it would be desirable to have the alloy remain austenitic over a wide range of service temperatures, for example from substantially below room temperature to substantially above room temperature, so that the alloy has practical utility.

As an illustration, Military Specification MIL-F-85421 requires a product that is functional to about −55° C. If the product comprises a shape memory alloy, then for convenience in shipping the product in the heat-unstable configuration, the product should not recover prior to about 50° C. It is a matter of commercial reality, within and without the military, that the product satisfy these requirements.

It is also desirable that the alloy be martensitic in the vicinity of room temperature so that the article can be fabricated, stored, and shipped at or near room temperature. The reason for this is that in the case of an article made from the alloy, a coupling, for example, the article would not recover prematurely.

Conceptually, one way to achieve these desirable results, to wit, an alloy that is martensitic near room temperature and which is also austenitic over a large range of temperatures including room temperature, is to have an alloy which exhibits a sufficiently wide transformation hysteresis, say, greater than about 125° C. If the hysteresis were sufficiently wide and room temperature could be located near the middle of the hysteresis, then the alloy could be fabricated and conveniently stored while in the martensitic condition. Since the hysteresis is sufficiently wide, the alloy would not transform to austenite until heated substantially above room temperature. This heating would not be applied until the alloy (in the form of a coupling, for example) was installed in its intended environment. The alloy, which would then be in the austenitic condition, would remain in the austenitic condition after cooling down since the service temperature (which may be above or below room temperature) would be substantially above the martensite transformation temperature. Thus, the above-noted desirable results could be achieved.

Unfortunately, there is believed to be no commercially viable nickel/titanium-based alloy that has a hysteresis sufficiently wide to achieve these desirable results.

For example, the commercially viable near equiatomic binary nickel-titanium alloys can have a hysteresis width of about 30° C. The location of the hysteresis for this alloy is also extremely composition sensitive so that while the hysteresis can be shifted from sub-zero temperatures to above-zero temperatures, the width of the hysteresis does not appreciably change. Thus, if the alloy were martensitic at room temperature, the service temperature must be above room temperature. Similarly, if the service temperature was at room temperature, the alloy would be martensitic below room temperature so that the alloy would require special cold-temperature equipment for fabrication, shipping, and storage. Ideally, as discussed above, room temperature should be located near the middle of the transformation hysteresis. However, since the width of the hysteresis in the binary alloy is so narrow, the range of service temperatures for any particular alloy is necessarily limited. As a practical matter, the alloy would have to be changed to accommodate any change in service temperatures.

It can be appreciated that the relative lack of commercialization of shape memory alloys must be due, at least in part, to their extreme sensitivity to temperatures as discussed above. Alloying and processing have not solved the problem.

Nickel/titanium/iron alloys, e.g., those in Harrison et al., U.S. Pat. No. 3,753,700, while having a wide hysteresis, up to about 70° C., are the typical cryogenic alloys which always undergo the martensite/austenite transformation at sub-zero temperatures. It should be noted that in general, the colder shape-memory alloys such as the cryogenic alloys have a wider transformation hysteresis than the warmer shape memory alloys. In the case of the cryogenic alloys, the alloys must be kept very cold, usually in liquid nitrogen, to avoid the transformation from martensite to austenite. This makes the use of shape memory alloys inconvenient, if not uneconomical.

The nickel/titanium/copper alloys of Harrison et al., U.S. patent application No. 537,316, filed Sept. 28, 1983, and the nickel/titanium/vanadium alloys of Quin, U.S. Pat. No. 4,505,767 are not cryogenic but their hysteresis may be extremely narrow (10°–20° C.) such that their utility is limited for couplings and similar articles.

The problems experienced with the nickel/titanium based shape memory alloys have been somewhat overcome by processing in the copper-based shape memory alloys. It is now known that the hysteresis in copper-based shape memory alloys can be temporarily expanded by mechanical preconditioning, austenitic aging and heat treating. In this regard, see Brook et al., U.S. Pat. Nos. 4,036,669; 4,067,752; and 4,095,999, The methods of the Brook et al. patents have been applied to nickel/titanium-based alloys; however, it has been found that these methods have no beneficial effect on nickel/titanium-based alloys.

It is known that under certain conditions the hysteresis of nickel/titanium-based alloys can be shifted as opposed to expanded. It should be understood that shifting of the hysteresis means that the $M_s$, $M_f$, $A_s$, and $A_f$ temperatures have all been translated to $M_s'$, $M_f'$, $A_s'$ and $A_f'$ such that there is substantially no change in the width of the hysteresis. It should be noted that the translated transformation temperatures may be higher or lower than the normal transformation temperatures. On the other hand, expansion of the hysteresis should generally be understood to mean that $A_s$ and $A_f$ have been elevated to $A_s'$ and $A_f'$ while at least $M_s$ and usually also $M_f$ remain essentially constant. Aging, heat treatment, composition, and cold work can all effectively shift the hysteresis. For example, if the stress is applied to the shape memory alloy at room temperature the hysteresis may be shifted so that the martensite phase can exist at a temperature at which there would normally be austenite. Upon removal of the stress, the alloy would isothermally (or nearly isothermally) transform from martensite to austenite.

Miyazaki et al., ("Transfomation Pseudoelasticity and Deformation Behavior in a Ti-50.6 at % Ni Alloy", *Scripta Metallurgica,* vol. 15, no. 3, pp. 287–292, (1981) have studied the deformation behavior of binary nickel-titanium alloys. As implied in FIG. 3 of this reference, the austenite transformation temperatures can be elevated when nonrecoverable strain is imparted to the alloy. That is, when the alloy was strained to 8% or higher and the stress then removed, there was some component of the strain which remained at the deformation temperature of 243° K. (compared to an $A_f$ of 221° K.). This component recovered when heated to 373° K. (see dotted lines on FIG. 3) although the precise recovery temperature was never measured. It is not clear from this reference whether the hysteresis was shifted or expanded since the binary nickel-rich alloy tested is extremely unstable when rapidly quenched as was done in this reference. In fact, one skilled in the art would have concluded that the hysteresis was shifted and not expanded due to the unstable alloy tested. There is no illustration of the transformation hysteresis to contradict this conclusion.

In the Melton et al. patent previously mentioned, a nickel/titanium/copper alloy was deformed beyond a critical strain so as to impart nonrecoverable strain. However, no expansion of the transformation hysteresis was observed.

While it can be appreciated that it would be desirable to have a nickel/titanium-based shape memory alloy and article with a sufficiently wide transformation hysteresis, the prior art has thus far remained silent on a way to achieve it.

As mentioned earlier, shape-memory alloys have found use in pipe couplings. The pipe coupling may be a monolithic pipe coupling as described in the earlier-mentioned Harrison and Jervis patents. Alternatively, the pipe coupling may be a composite coupling as described in the earlier-mentioned Clabburn patent and in U.S. Pat. Nos. 4,379,575; 4,455,041; and 4,469,357 to Martin, the disclosures of which are incorporated herein by reference. As noted in Martin, the composite coupling comprises a driver member and a sleeve member.

Composite couplings present the problem of how best to assemble them. In the Martin patents, there are noted several ways to assemble the couplings. In one way, the sleeve may be assembled with the driver just after the expansion of the driver so as to take advantage of the elastic springback of the material. The driver and sleeve members are then stored in a cryogenic fluid until ready for installation.

Alternatively, the driver alone may be stored in a cryogenic fluid and then joined with the sleeve at the time of installation. Once joined with the sleeve, the driver is allowed to fully recover.

In practice, the driver may be expanded and, after springback has occurred, joined with the sleeve while both are immersed in a cryogenic fluid. Since no recovery of the driver has occurred, the sleeve is only loosely joined and would, in fact, become separated from the driver if means were not provided to prevent this separation. The means to prevent this separation is usually provided in the form of a flaring of one end of the sleeve which makes for a slight interference fit between the sleeve and the driver.

All of these methods suffer from the disadvantage that the driver must be stored in a cryogenic or other cold fluid prior to installation. The second method suffers from the additional disadvantage that the driver may recover prior to joining with the sleeve, thus rendering useless the composite coupling. The last method disadvantageously requires the additional step of flaring the sleeve to prevent disengagement of the driver and sleeve.

In Clabburn, a keeper is utilized to apply a stress sufficient to temporarily raise the austenite transformation temperature. The shape-memory alloy remains in the martensitic state while the stress is applied. This method is known as constrained storage.

It can be appreciated that it would be desirable to have the driver and sleeve preassembled such that one could merely remove the preassembled coupling from a carton on a shelf and then proceed to install the coupling without the need to worry about cold storage of the coupling. Thus far, the prior art has remained silent on a way to achieve this desirable result.

Thus, it is an object of the invention to have a method of preassembling a composite coupling without the need for a cryogenic or other cold fluid.

It is another object of the invention to have a method of preassembling a composite coupling wherein the preassembled coupling may be stored without the need for a cryogenic or other cold fluid.

It is a further object of the invention to have a composite coupling preassembled by the method of the invention so that cryogenic or other cold fluid is not necessary.

These and other objects of the invention will become apparent to those skilled in the art after reference to the following description considered in conjunction with the accompanying drawings.

BRIEF SUMMARY OF THE INVENTION

There is disclosed a method of preassembling a composite coupling. The coupling has at least one heat recoverable driver member and at least one metallic insert. The driver member is made from a nickel/titanium-based shape memory alloy having a transformation hysteresis defined by $M_s$, $M_f$, $A_s$, and $A_f$ temperatures. The method comprises overdeforming the driver member by applying a stress sufficient to cause nonrecoverable strain in the driver member so that the $A_s$ and $A_f$ temperatures are temporarily raised to $A_s'$ and $A_f'$, respectively; removing the stress; engaging the driver member and insert; and warming the driver and insert to a temperature less than $A_s'$.

We have found that by taking advantage of the expansion of the hysteresis caused by overdeformation of the driver member the composite coupling may be preassembled simply and efficiently.

DETAILED DESCRIPTION OF THE INVENTION

The benefits of expansion of the shape memory alloy transformation hysteresis have already been disclosed in our U.S. patent application Ser. No. 668,771 filed Nov. 6, 1984 entitled "A Method of Processing a Nickel/-Titanium-Based Shape Memory Alloy and Article Produced Therefrom" the disclosure of which is incorporated herein by reference. We have found that if in conjunction with the expansion of the hysteresis of the driver member, the driver member is preassembled with the sleeve, then the preassembly is greatly facilitated.

Figure 1:
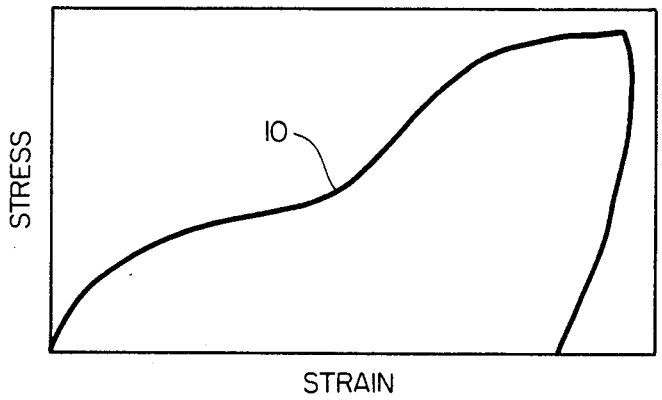
FIG. 1 is a schematical stress/strain curve for a nickel/titanium-based shape memory alloy.

Referring to the figures in more detail FIG. 1 schematically illustrates a stress/strain curve for a shape memory alloy which was overdeformed. The load was then removed. With overdeformation there is by definition a substantial amount of non-recoverable strain imparted to the alloy. Nonrecoverable strain will occur when the alloy, generally speaking, is strained past its second yield point indicated approximately by reference numerical 10. After removal of the stress, the alloy was heated.

Figure 2:
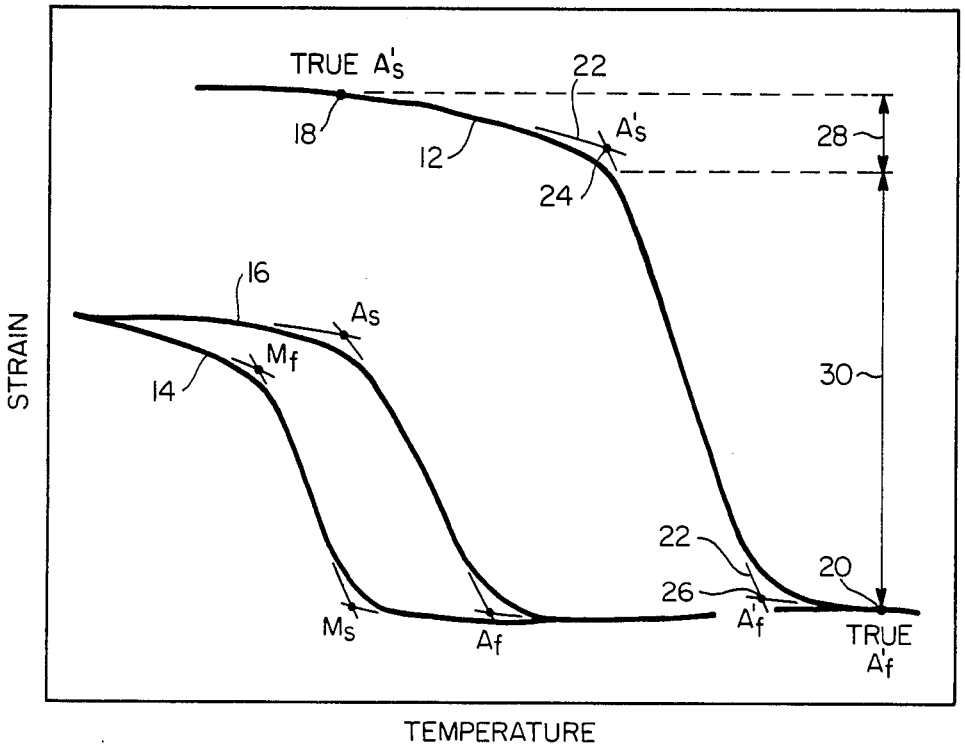
FIG. 2 schematically illustrates the shape memory alloy strained in FIG. 1 in the unrecovered and recovered state.

In FIG. 2 curve 12 illustrates the heating after the removal of the stress. When the transformation was complete the alloy was cooled down as illustrated by curve 14. During the cooling down under a small load the $M_s$ and $M_f$ temperatures were measured. The alloy was then reheated (curve 16) to measure the recovered austenitic transition temperatures $A_s$ and $A_f$.

As we stated in our patent application above there is more than one way to locate on a transformation hysteresis curve the martensitic and austenitic transformation temperatures. Referring again to FIG. 2 the literal starting and ending of the austenitic transformation may be indicated for example by points 18 and 20 respectively on curve 12. However, the austenitic transformation effectively begins at about point 24 (denoted as $A_s'$) and the austenitic transformation effectively ends at about point 26 (denoted as $A_f'$). Thus it can be said that the bulk of the transformation occurs between $A_s'$ and $A_f'$. The same is true for the other transformations as illustrated by curves 14 and 16. The effective austenitic and martensitic transformation temperatures may be conveniently determined by the intersection of tangents to the transformation hysteresis curves. For example, tangents 22 on curve 12 locate $A_s'$ and $A_f'$.

Whenever the austenitic and martensitic transformation temperatures are mentioned in this specification it should be understood that these temperatures refer to the austentic and martensitic transformation temperatures determined by the above noted method of intersecting tangents. Whenever the literal starting and ending points of the martensitic and austentic transformations are indicated these temperatures will be referred to as the true martensitic and austenitic transformation temperatures. Thus, the literal starting and ending points of the austenitic transformation after expansion of the hysteresis are referred to as true $A_s'$ and true $A_f'$.

Curves 14 and 16 represent the shape memory alloy transformation hysteresis in the recovered state while curves 12 and 14 represent the shape memory alloy transformation hysteresis in the unrecovered state. Thus it can be seen that the overdeformation of the alloy according to the patent application above has substantially and temporarily widened the hysteresis.

Now according to the invention there is disclosed a method of preassembling a composite coupling having at least one heat recoverable driver member and at least one metallic insert. The driver member is made from a nickel/titanium-based shape memory alloy having a transformation hysteresis defined by $M_s$, $M_f$, $A_s$ and $A_f$ temperatures. The method comprises overdeforming the driver member by applying a stress sufficient to cause nonrecoverable strain in the driver member so that the $A_s$ and $A_f$ temperature are temporarily raised to $A_s'$ and $A_f'$, respectively. The method further comprises removing the stress; engaging the driver member and insert; and then warming the driver and insert to a temperature less than $A_s'$.

According to the invention, there must be at least one driver member; however, there may be more than one such as when ring drivers are used. Similarly, there must be at least one insert but there may be more than one such as when mult-piece inserts are utilized.

It should be understood that while the driver and insert preferably need to be warmed to a temperature which is less than $A_s'$, they in any case need to be raised to a temperature above the true $A_s'$. The reason for this is that below true $A_s'$ there will not be any recovery of the shape memory alloy. Referring again to FIG. 2 it can be seen that between true $A_s'$ and $A_s'$ there will be a small amount of recovery indicated by 28. After $A_s'$ is passed the bulk of the recovery will effectively occur as indicated by 30. From FIG. 2 then it is apparent that to get any amount of recovery the material has to be heated above true $A_s'$. However, since the amount of recovery occurring between true $A_s'$ and $A_s'$ is much less than the recovery occurring between $A_s'$ and true $A_f'$ little shape memory recovery will actually be lost by allowing the driver member to partially recover according to the invention. This partial recovery is not so great as to crush the insert but only so great as to be able to hold the insert and driver snugly engaged.

It should be understood that the metallic insert may take many forms. For example, the insert may be tubular, tapered or slotted, all of which are disclosed in the above Martin patents. Additionally, the insert may be single or multipiece. Finally, the insert may have an irregular shape such as to be x-shaped, y-shaped or t-shaped.

The insert may also have sealing means as also disclosed in the above Martin patents. The sealing means may comprise, for example, teeth or gall-prone materials.

It should also be understood that the driver member may take many forms. It is preferred, however, that the driver member be a tubular driver or a ring driver.

In the step of overdeforming the driver member it is preferred that a stress is applied sufficient to cause at least one percent of nonrecoverable strain in the driver member. Of course the nonrecoverable strain may be much more than one percent which is usually the case but it is preferred that there be at least one percent strain.

It is preferred that the overdeforming take place at a temperature which is less than about the maximum temperature at which martensite can be stress-induced. This temperature is also known as the $M_d$ temperature. The reason for this is that when the material has been deformed at a temperature greater than $M_d$ the amount of strain recoverable upon subsequent heating is drastically and dramatically reduced. Generally, the more the deformation temperature is raised above $M_d$, the greater will be the reduction in recoverable strain. It is most preferred that the overdeforming temperature be between $M_s$ and $A_s$.

It is desirable that the nickel/titanium-based shape memory alloy has an $M_s$ temperature less than about 0° C. However, it is preferred that the nickel/titanium-based shape memory alloy is stable, does not contain an R phase and has an $M_s$ temperature less than about 0° C. To those skilled in the art the R phase is known as a transitional phase between the austenite and martensite and has a structure different than either. The effect of the R phase is to depress the austenitic and martensitic transformation temperatures. Alloys that are stable (i.e. exhibit temper stability) have an $M_s$ that does not change more than about 20° C. after annealing and water quenching and subsequent aging between 300° and 500° C.

The nickel/titanium-based shape memory alloy may be a binary or at least a ternary. In the case where the shape memory alloy is a ternary, the ternary may comprise nickel/titanium and at least one other element selected from the group consisting of iron, cobalt, vanadium, aluminum and niobium. It is most preferred that the ternary nickel/titanium-based shape memory alloy comprise nickel, titanium and niobium.

It is believed that the teaching of this invention will have most application to couplings processed by the method of the invention. However it should be understood that the teaching of the invention applies to other articles and devices processed by the method of the invention.

The advantages of the invention will become more apparent after reference to the following examples.

EXAMPLE 1

A cylindrical driver member was made from an alloy having the composition of 47 atomic percent nickel, 44 atomic percent titanium and 9 atomic percent niobium. The nickel/titanium/niobium alloys, in general, are the most preferred alloys. These alloys were described in our U.S. patent application Ser. No. 668,777 filed Nov. 6, 1984, entitled "Nickel/Titanium/Niobium Shape Memory Alloy and Article", the disclosure of which is incorporated by reference herein.

The driver was melted and processed as noted in our patent application above except that a coupling was machined instead of a ring. The driver was machined to have an inside diameter of 0.847 inches, an outside diameter of 1.313 inches and a length of 2.12 inches.

A cylindrical insert was then made to be eventually joined with the driver so as to form a composite coupling. The insert was machined from 316 stainless steel so as to have an inside diameter of 0.850 inches, an outside diameter of 0.970 inches and a length of 2.12 inches. It is not necessary to the invention that the insert be made from stainless steel. It is only necessary that the insert be made from a material that is sufficiently soft such that it may be crushed by the driver upon full recovery thereof.

With the particular alloy utilized, the $M_s$ temperature was −90° C., the $A_s$ temperature was −56° C. and the $M_d$ temperature was −10° C. Although not actually measured, such an alloy expanded about 16% at −50° C. would be expected to have a true $A_s'$ of −52° C. and an $A_s'$ of +52° C. Thus, immediately after expansion, the driver was near the literal starting temperature of the austenitic transformation of the temporarily expanded transformation hysteresis.

After expansion, the driver was removed from the cold fluid and placed on a work bench. The insert was then slipped into the driver. Thereafter, the driver and insert were allowed to warm to room temperature, which it is noted is substantially below $A_s'$. It was found that the driver and insert were snugly engaged and could only be moved relative to each other with great difficulty. It should be noted that while the driver and insert became snugly engaged, there was no crushing of the insert.

The driver, prepared as described above, would be expected to have about 8% recoverable strain. About 1% of that recoverable strain was utilized in the preassembling of the driver and insert. Thus, about 7% recoverable strain remains for the actual coupling of the substrates.

The composite coupling is now preassembled and ready for storage or use.

EXAMPLE 2

Commercially pure titanium, carbonyl nickel and niobium were weighed in proportions so as to give a composition of 47 atomic percent nickel, 44 atomic percent titanium, and 9 atomic percent niobium. The total mass for test ingots was about 330 grams. These metals were placed in a watercooled, copper hearth in the chamber of an electron beam melting furnace. The chamber was evacuated to $10^{-5}$ Torr and the charges were melted and alloyed by use of the electron beam. The resulting ingots were hot swaged in air at approximately 850° C. The resulting bar was machined into rings which were vacuum annealed in 850° C. for 30 minutes and then furnace cooled. The rings were then enlarged, unstressed and subsequently heated so as to measure the free recovery of the alloy. The results are tabulated below in Table 1.

TABLE 1

| Nickel/Titanium/Niobium Ternary (47/44/9) | | | | | | |
|---|---|---|---|---|---|---|
| | Expansion Temperature, °C. | | | | | |
| | −196 | −90 | −70 | −30 | −10 | −0 |
| True $A_s'$, °C. | −62 | −56 | −25 | −67 | −60 | −50 |
| $A_s'$, °C. | 43 | 52 | 54 | 53 | 44 | 34 |
| $M_s$, °C. | −90 | −90 | −90 | −90 | −90 | −90 |
| $A_s$, °C. | −56 | −56 | −56 | −56 | −56 | −56 |
| $M_d$, °C. | −10 | −10 | −10 | −10 | −10 | −10 |

While the data relate to the expansion of rings, the data is nevertheless indicative of how the material would perform as a driver. In each case, there is a substantial difference between true $A_s'$ and $A_s'$ indicating that the material will achieve the objects of the invention. The true $A_s'$ for the sample expanded at −70° C. is believed to be an anomaly in that the sample may have inadvertently warmed to near room temperature prior to the actual measurement of true $A_s'$ and $A_s'$.

It is preferred that the material be expanded at temperatures no higher than $M_d$ (−10° C. in Table 1) since expansion at higher temperatures will cause a dramatic decrease in the amount of recoverable strain obtainable. However, expansion at temperatures higher than $M_d$ does not appear to affect the difference between true $A_s'$ and $A_s'$.

It is most preferred that expansion takes place between $A_s$ and $M_s$. This is because at temperatures higher than $A_s$ or lower than $M_s$, elastic springback of the material may be increased. Additionally, the material has somewhat more ductility when expanded between $A_s$ and $M_s$.

EXAMPLES 3 to 7

Commercially pure titanium and carbonyl nickel were weighed in proportions so as to give a composition of 50.7 atomic percent nickel and 49.3 atomic percent titanium. Additionally, commercially pure titanium, carbonyl nickel and amounts of vanadium, cobalt, aluminum and iron were weighed in proportions so as to give compositions of: 46 atomic percent nickel, 49 atomic percent titanium and 5 atomic percent vanadium; 49 atomic percent nickel, 49 atomic percent titanium and 2 atomic percent cobalt; 50 atomic percent nickel, 48.5 atomic percent titanium and 1.5 atomic percent aluminum; and 47 atomic percent nickel, 50 atomic percent titanium and 3 atomic percent iron.

These metals were placed in a water-cooled, copper hearth in the chamber of an electron beam melting furnace. The chamber was evacuated to $10^{-5}$ Torr and the charges were melted and alloyed by use of the electron beam.

The resulting iron-containing ingots were hot swaged at approximately 850° C. Round, tensile bars (¼" in diameter) were then machined from the hot swaged ingot, vacuum annealed at 850° C. for 30 minutes, and then furnace cooled. The tensile bars were then elongated. After elongation, the stress was removed and the bars were heated unrestrained so as to effect recovery of the shape memory alloy. The recovery was monitored and plotted as a function of temperature. When the transformation was complete, the sample was cooled and then reheated so as to complete the measurement of the martensitic and austenitic transformation temperatures before recovery and after recovery. The results are tabulated in Table 2.

The remaining ingots were hot swaged and hot rolled in air at approximately 850° C. to produce a strip of approximately 0.025-in. thickness. Samples were cut from the strip, descaled and vacuum annealed at 850° C. for 30 minutes and furnace cooled. The strip was then elongated. After elongation, the stress was removed and the strip was heated unrestrained so as to effect recovery which was monitored and plotted as a function of temperature. When the transformation was complete, the sample was cooled and then reheated so as to complete the measurement of the martensitic and austenitic transformation temperatures before recovery and after recovery. In the case of the cobalt alloy, the martensitic and austenitic transformation temperatures were measured with a load of 20 ksi and then extrapolated to 0 ksi. The results are tabulated below in Tables 2 to 6.

TABLE 2

| Nickel/Titanium/Iron Ternary (47/50/3) | |
|---|---|
| | Expansion Temperature −196° C. |
| True $A_s'$ °C. | < −196 |
| $A_s'$ °C. | −90 |
| $M_s$, °C. | −154 |
| $A_s$, °C. | −137 |

TABLE 3

| Nickel/Titanium Binary (50.7/49.3) | |
|---|---|
| | Expansion Temperature −50° C. |
| True $A_s'$, °C. | −55 |
| $A_s'$, °C. | 32 |
| $M_s$, °C. | −30 |
| $A_s$, °C. | −15 |

TABLE 4

| Nickel/Titanium/Vanadium Ternary (46/49/5) | |
|---|---|
| | Expansion Temperature −100° C. |
| True $A_s'$, °C. | 20 |
| $A_s'$, °C. | 84 |
| $M_s$, °C. | 10 |
| $A_s$, °C. | 40 |

TABLE 5

| Nickel/Titanium/Cobalt Ternary (49/49/2) | |
|---|---|
| | Expansion Temperature −100° C. |
| $A_s'$, °C. | −100 |
| $A_s'$, °C. | −54 |
| $M_s$, °C. | −154 |
| $A_s$, °C. | −100 |

TABLE 6

| Nickel/Titanium/Aluminum (50/48.5/1.5) | |
|---|---|
| | Expansion Temperature −100° C. |
| True $A_s'$, °C. | −24 |
| $A_s'$, °C. | 20 |
| $M_s$, °C. | −72 |
| $A_s$, °C. | −32 |

As stated earlier it is believed that the above data while not derived from drivers per se is nevertheless indicative of how each of these materials will perform as a driver. Thus, for each of these materials, in addition to having an expanded hysteresis, there is a substantial difference between true $A_s'$ and $A_s'$ so that these materials are suitable to achieve the objects of the invention.

Finally, it can be appreciated that while the samples in the above examples were deformed by application of a tensile stress, the objects of the invention can be fully achieved by application of a compressive stress.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

We claim:

1. A method of preassembling a composite coupling having at lest one heat-recoverable driver member and at least one metallic insert, the driver member made from a nickel/titanium-based shape memory alloy having a transformation hysteresis defined by $M_s$, $M_f$, $A_s$ and $A_f$ temperatures, the method comprising: overdeforming the driver member by applying a stress sufficient to cause nonrecoverable strain in the driver member so that the $A_s$ and $A_f$ temperatures are temporarily raised to $A_s'$ and $A_f'$, respectively; removing the stress; engaging the driver member and insert; and warming the driver member and insert to a temperature less than $A_s'$, wherein said warming is insufficient to raise the temperature of the driver above the temporarily raised austenitic transformation temperature range so that only a small amount of recovery of the shape memory alloy driver member occurs.

2. The method according to claim 1 wherein in the step of overdeforming the driver member, a stress is applied sufficient to cause at least one percent of nonrecoverable strain in the driver member.

3. The method according to claim 1 wherein the step of overdeforming takes place at a temperature which is less than about the maximum temperature at which martensite can be stress-induced.

4. The method according to claim 3 wherein the overdeforming temperature is between $M_s$ and $A_s$.

5. The method according to claim 1 wherein the nickel/titanium-based shape memory alloy has an $M_s$ less than about 0° C.

6. The method according to claim 1 wherein the nickel/titanium-based shape memory alloy is stable, does not contain an R phase, and has an $M_s$ less than about 0° C.

7. The method according to claim 1 wherein the nickel/titanium-based shape memory alloy is a binary.

8. The method according to claim 1 wherein the nickel/titanium-based shape memory alloy is at least a ternary.

9. The method according to claim 8 wherein the ternary nickel/titanium-based shape memory alloy comprises nickel, titanium and at least one other element selected from the group consisting of iron, cobalt, vanadium, aluminum and niobium.

10. The method according to claim 9 wherein the ternary nickel/titanium-based shape memory alloy comprises nickel, titanium and niobium.

11. A composite coupling having at least one heat-recoverable driver member and at least one metallic insert, the driver member made from a nickel/titanium-based shape memory alloy having a transformation hysteresis defined by $M_s$, $M_f$, $A_s$ and $A_f$ temperatures, the coupling processed by the method comprising: overdeforming the driver member by applying a stress sufficient to cause nonrecoverable strain in the driver member so that the $A_s$ and $A_f$ temperatures are temporarily raised to $A_s'$ and $A_f'$, respectively; removing the stress; engaging the driver member and insert; and warming the driver member and insert to a temperature less than $A_s'$, wherein said warming is insufficient to raise the temperature of the driver above the temporarily raised austenitic transformation temperature range so that only a small amount of recovery of the shape memory alloy driver member occurs.

12. The coupling processed by the method according to claim 11 wherein in the step of overdeforming the driver member, a stress is applied sufficient to cause at least one percent of nonrecoverable strain in the driver member.

13. The coupling processed by the method according to claim 11 wherein the step of overdeforming takes place at a temperature which is less than about the maximum temperature at which martensite can be stress-induced.

14. The coupling processed by the method according to claim 13 wherein the overdeforming temperature is between $M_s$ and $A_s$.

15. The coupling processed by the method according to claim 11 wherein the nickel/titanium-based shape memory alloy has an $M_s$ less than about 0° C.

16. The coupling processed by the method according to claim 11 wherein the nickel/titanium-based shape memory alloy is stable, does not contain an R phase, and has an $M_s$ less than about 0° C.

17. The coupling processed by the method according to claim 11 wherein the nickel/titanium-based shape memory alloy is a binary.

18. The coupling processed by the method according to claim 11 wherein the nickel/titanium-based shape memory alloy is at least a ternary.

19. The coupling processed by the method according to claim 18 wherein the ternary nickel/titanium-based shape memory alloy comprises nickel, titanium and at least one other element selected from the group consisting of iron, cobalt, vanadium, aluminum and niobium.

20. The coupling processed by the method according to claim 19 wherein the ternary nickel/titanium-based shape memory alloy comprises nickel, titanium and niobium.

* * * * *